FIG. 1
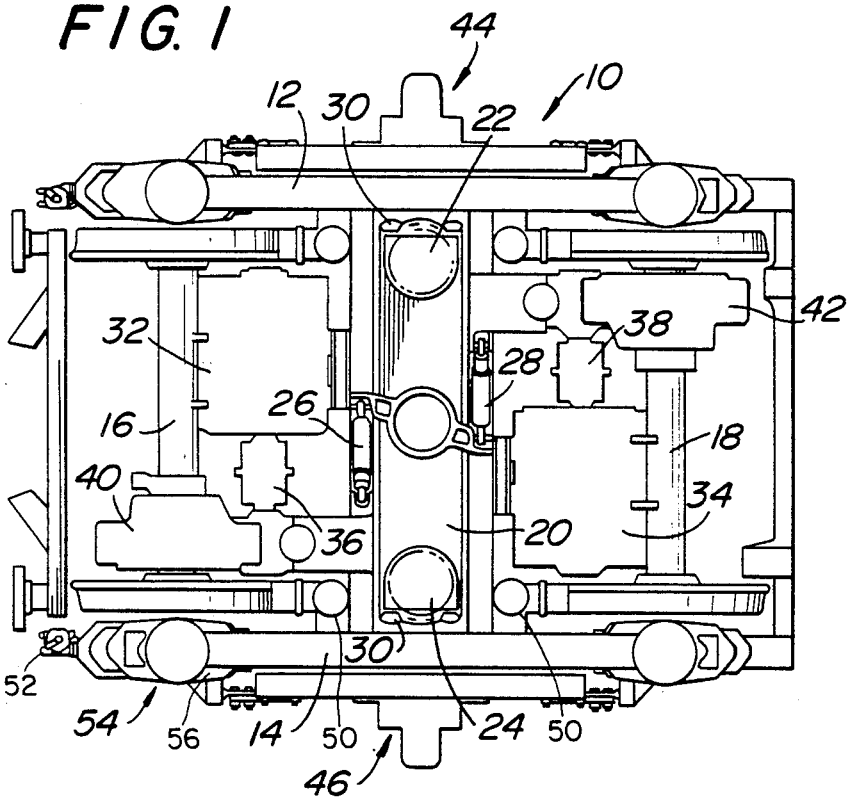
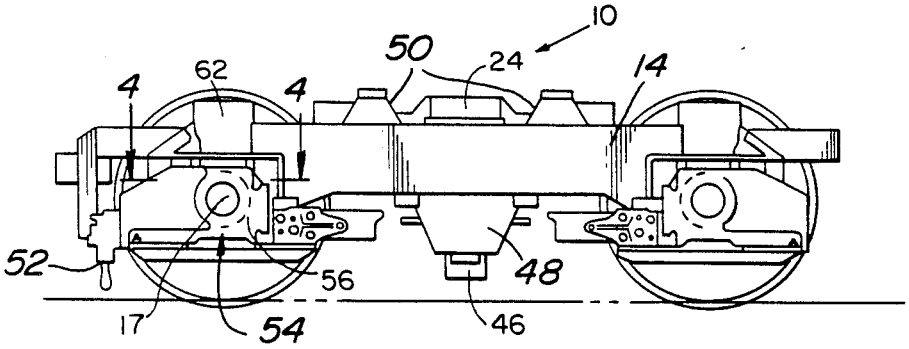
FIG. 2

United States Patent [19]

Dean, II

[11] Patent Number: 4,488,495

[45] Date of Patent: Dec. 18, 1984

[54] SOFT PRIMAR SUSPENSION SYSTEM FOR A RAILWAY CAR

[75] Inventor: Walter C. Dean, II, Collegeville, Pa.

[73] Assignee: The Budd Company, Troy, Mich.

[21] Appl. No.: 334,987

[22] Filed: Dec. 28, 1981

[51] Int. Cl.[3] ..... B61F 3/04; B61F 5/30; B61F 5/38

[52] U.S. Cl. ..... 105/224.1; 105/453; 267/4

[58] Field of Search ..... 105/218 A, 218 R, 224 A, 105/224 R, 224.1, 453; 267/3, 4

[56] References Cited

U.S. PATENT DOCUMENTS

| | | | |
|---|---|---|---|
| 38,777 | 6/1863 | Gibson et al. | 267/4 X |
| 51,368 | 12/1865 | Vose | 267/4 X |
| 1,936,389 | 11/1933 | Hallguist | 267/4 X |
| 2,286,563 | 6/1942 | Mussey | 105/224.1 |
| 2,299,560 | 10/1942 | Travilla, Jr. | 105/224.1 X |
| 2,410,402 | 11/1946 | Ledwinka | 105/224.1 |
| 2,802,662 | 8/1957 | Hirst | 105/224.1 X |
| 4,046,080 | 9/1977 | Dieling et al. | 105/224.1 X |

*Primary Examiner*—Howard Beltran

*Attorney, Agent, or Firm*—Edward M. Farrell; Herman Foster; Thomas I. Davenport

[57] ABSTRACT

A low rate soft primary system for a railway truck includes a pair of longitudinally disposed assemblies on opposite sides of a journal bearing for carrying a wheel-axle unit. Each of said assemblies includes a plurality of laminated rubber strips separated by relatively thin metal strips oriented parallel to the vertical axis of the journal bearing. The layers of the laminated assembly form angles opening towards or away from the journal bearing somewhat in the shape of chevrons. The assemblies provide relatively high spring rates for lateral and longitudinal loads and low spring rates for vertical loads.

1 Claim, 4 Drawing Figures

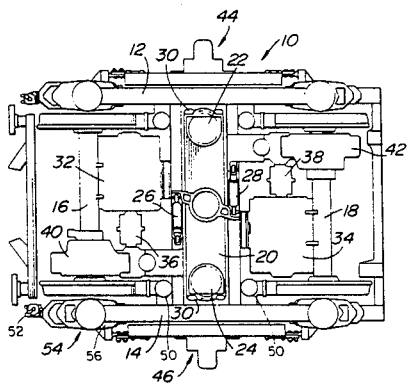

FIG. 3
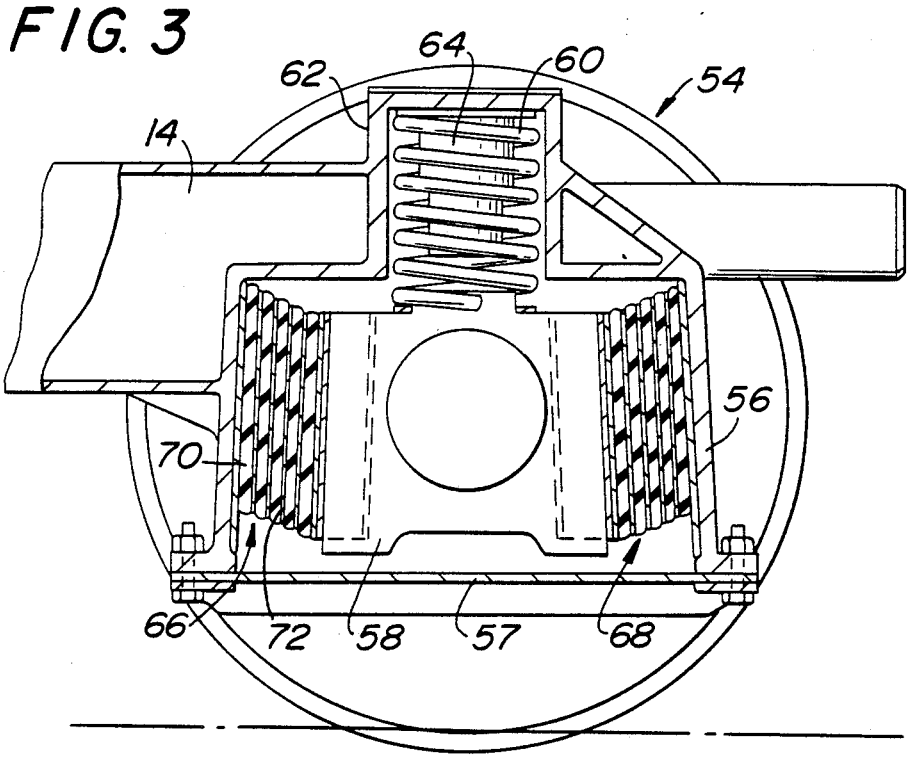
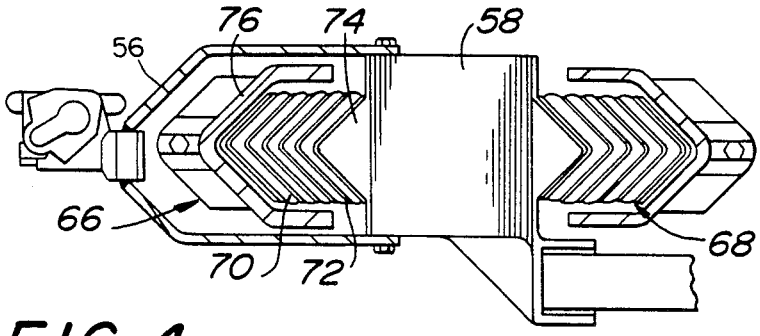
FIG. 4

SOFT PRIMAR SUSPENSION SYSTEM FOR A RAILWAY CAR

BACKGROUND OF THE INVENTION

In a railway car, the primary suspension system generally refers to the suspension between the journal bearing assembly and the truck frame. The journal bearing assembly carries a wheel axle unit and acceleration forces generated by the wheel are directed to the primary suspension system with some of the forces being transmitted through the primary suspension system to the side frame.

The secondary suspension system refers to the system between a bolster on the truck and the car body and generally include air or mechanical springs. The present invention is directed to primary suspension systems.

It is sometimes required to meet certain equalization standards in railway cars. In general, such equalization standards require that one wheel of the truck be lifted from a rail, for example, two inches without changing the load on the other three wheels beyond a prescribed amount, for example, about 20 percent. The reason for such equalization requirement is to assure that a wheel of a truck does not lose contact with the rail when the car is traveling over an even track. One wheel leaving the rail could cause the car to go off the tracks.

Generally in equalizer beam systems, a beam extends over two longitudinally spaced wheels. The ends of the beam includes guide sections which are adapted to slide up and down vertically on members associated with the wheels. This involves friction and wearing of the parts involved. Springs are disposed between the beam and the side frame associated wih the two wheels.

If the rubber springs in the primary suspension system were used alone to satisfy the equilization standards, a large amount of rubber would have to be used to provide a sufficiently low vertical spring rate while supporting the total weight of the car. If this is done, the rubber spring has an excessively low spring rate in the longitudinal and lateral directions which will not allow proper guidance of the axles.

Rubber laminated spring assemblies involving relatively wide angles between angular portions of the laminated rubber with interposed metal strips have been used in the past. These assemblies have been angularly disposed with respect to the journal bearings. Because of the large angles between the laminations and the angular disposition of the assemblies with respect to the journal bearing, such assemblies have relatively soft lateral spring rates, somewhat low vertical spring rates and high longitudinal spring rates. The vertical rate of these assemblies is sufficiently high to support the weight of the car without additional springs, but is generally incompatible with the equalization requirement.

OBJECTS OF THE INVENTION

It is an object of this invention to provide an improved primary suspension system for a railway truck capable of meeting equalization standards.

It is a further object of this invention to provide an improved primary suspension system for a railway truck which has a very low vertical spring rate and high lateral and longitudinal spring rates.

BRIEF SUMMARY OF THE INVENTION

In accordance with the present invention, a railway truck includes a journal bearing for carrying a wheel-axle unit. Spring means are disposed over said journal bearing to carry a portion of the vertical load. A pair of longitudinally disposed assemblies are disposed on opposite sides of the journal bearing. Each of the assemblies include a plurality of laminated rubber strips separated by relatively thin metal strips. The rubber and metal strips are oriented parallel to the vertical axis of the journal bearing, and each layer of the laminated assembly is shaped to form an angle opening towards or away from the journal bearing. The assemblies transmit all longitudinal and lateral loads into the side frame and provide relatively high spring rates for these loads while providing a low spring rate for vertical loads and supporting part of that vertical load.

Other objects and advantages of the present invention will be apparent and suggest themselves to those skilled in the art from a reading of the following specification and claims, taken in conjunction with the accompanying drawings.

BRIEF DESCRIPTION OF THE DRAWINGS

FIG. 1 is a top view illustrating a typical truck in which the present invention may be used;

FIG. 2 is a side view of the truck shown in FIG. 1;

FIG. 3 is a side view, partly in cross-section, illustrating one of the primary suspension systems of the truck shown in FIGS. 1 and 2; and FIG. 4 is a cross-sectional view taken along lines 4—4 of FIG. 2.

DETAILED DESCRIPTION OF THE PREFERRED EMBODIMENTS

Referring to FIG. 1, a railway truck 10 includes a pair of side frames 12 and 14 having wheel axle units 16 and 18 secured thereto. A bolster 20 includes spring pockets 22 and 24 designed to hold mechanical springs involved in the secondary suspension system. Conventional lateral shock absorbers 26 and 28 are attached between the bolster 20 and a portion of the truck below the bolster. Rubber bumper stops 30 are provided on the bolster.

The wheel axle units 16 and 18 are driven by motors 32 and 34 which are connected through coupling units 36 and 38. to gear boxes 40 and 42. Third rail assemblies 44 and 46 are attached to the side frames 12 and 14, respectively.

A pair of spring pockets are also attached to the side frames, with only one such spring pocket 48 being illustrated in FIG. 2. Brake assemblies 50 are provided for braking the wheels of the wheel-axle units 16 and 18. A trip mechanism 52 is provided to automatically brake the car at prescribed points on the track when actuated by a track side protrusion. Most of the components mentioned thus far are found in conventional trucks.

A primary suspension system of the type involving the present invention is connected to the four ends of the axles of the wheel-axle units 16 and 18. Only one such suspension unit 54 will be described in connection with FIGS. 3 and 4, it being understood that the other three are similar in construction and operation.

Referring to FIGS. 3 and 4, along with FIGS. 1 and 2, the primary suspension system 54 includes a housing 56. The housing 56 is built into the side frame 14 in the manner illustrated.

A journal housing 58 is disposed within the primary suspension system housing 56 which includes a bottom retainer plate 57 secured thereto. The axle 17 of the wheel-axle unit 16 is disposed within the journal housing 58. A coil spring 60 is disposed within an upwardly extending portion 62 of the housing 56. A rubber member 64 is disposed within the coil spring 60 a short distance above the top of the journal housing 58. This rubber member prevents over travel of the journal bearing 58 when it reaches the limit of its upward travel. The coil spring 60 serves to carry part of the vertical load.

A pair of assemblies 66 and 68 are provided on both sides of the journal box 58. Each of these assemblies 66 and 68 comprise a series of rubber shear mounts that are arranged in angular fashion somewhat in the shape of chevrons. The chevron angle is close to 90° so that longitudinal and lateral spring rates will be approximately equal. Metal inserts are provided between each of the shear mounts in the assemblies 66 and 68. The shear mounts 66 and 68 are substantially the same and only the shear mount 66 will be described in detail.

The assembly 66 includes a plurality of flexible layers or laminations 70, which may be rubber or other suitable material. Metal strips 72 are disposed between each of the layers 70. The layers of rubber 70 and the strips 72 may be preformed and held between an angular member 74 secured to the journal box 58 and by an angular member 76 suitably mounted to the primary suspension housing 56. In some cases, the angles of the layers in the assemblies 66 and 68 may be in the opposite direction than that illustrated to achieve the same results.

The pairs of assemblies 66 and 68 may be considered as being disposed longitudinally along the truck on opposite sides of the journal bearing. The rubber and metal strips may be considered as being oriented approximately parallel to the vertical axis of the journal bearing. Each layer of the laminated assembly including the rubber shear strips and the metal strips form an angle opening toward or away from the journal bearing. The above arrangement provides a primary suspension system having a very low spring rate for vertical loads. At the same time, relatively high spring rates for lateral and longitudinal loads are provided by the suspension system and vertical sliding surfaces used in equalizer beam type suspensions are eliminated.

The angle of the rubber layer 70 and the metal strip 72 is approximately 90°. The metal strips between the layers of rubber act to significantly increase the shape factor of the rubber in compression making it much more stiff in compression. Yet the metal inserts do not contribute to stiffness in the shear. Consequently, as far as the vertical motion is concerned, the rubber strips will act as if no metal plates were present. However, if movement is involved in the longitudinal or lateral direction, compression of the rubber layers will result thereby resulting in relatively high spring rates.

The present suspension system makes it possible to meet certain equalization standards by providing an extremely soft primary suspension system which will maintain wheels on the truck on the track when one of the wheels is lifted a short distance. At the same time, the coil spring 64 in conjunction with the main primary suspension system provides sufficient loading during normal operation.

What is claimed is:

1. In a railway truck having a side frame for receiving a journal bearing housing for carrying a wheel-axle unit, a soft primary system disposed between said side frame and said journal bearing housing comprising:

(a) a pair of longitudinally disposed assemblies on opposite sides of said journal bearing housing;

(b) each of said assemblies including a plurality of laminated elastomeric strips separated by relatively thin metal strips to increase the shape factor of said elastomeric strips in compression making them stiffer in compression;

(c) said elastomeric and metal strips being oriented parallel to the vertical axis of said journal bearing housing and forming angle openings towards and away from the journal bearing housing to provide a low vertical spring rate;

(d) said angle openings being approximately at right angles to provide high and substantially equal longitudinal and lateral spring rates;

(e) a mechanical spring disposed over said journal box to support vertical loads thereon; and (f) an elastomer member disposed within said mechanical spring to provide stop means to limit the movement of said journal bearing housing;

whereby said assemblies provide relatively high spring rates for lateral and longitudinal loads and low spring rates for vertical loads for equalization.

* * * * *